US005268020A

United States Patent [19]

Claxton

[11] Patent Number: 5,268,020

[45] Date of Patent: Dec. 7, 1993

[54] DUAL IMPELLER VORTEX SYSTEM AND METHOD

[76] Inventor: Raymond J. Claxton, 7131 Greentree La., Dallas, Tex. 75214

[21] Appl. No.: 806,369

[22] Filed: Dec. 13, 1991

[51] Int. Cl.[5] ..... C22B 9/16

[52] U.S. Cl. ..... 75/708; 75/687; 266/235; 266/901

[58] Field of Search ..... 75/708, 687; 266/235, 266/901

[56] References Cited

U.S. PATENT DOCUMENTS

| | | | |
|---|---|---|---|
| 4,486,228 | 12/1984 | Ormesher | 75/65 R |
| 4,491,474 | 1/1985 | Ormesher | 75/65 R |
| 4,598,899 | 7/1986 | Cooper | 266/901 |
| 4,884,786 | 12/1989 | Gillespie | 266/235 |
| 4,893,941 | 1/1990 | Wayte | 366/265 |
| 4,907,784 | 3/1990 | Kusaka et al. | 266/235 |

*Primary Examiner*—Melvyn J. Andrews
*Attorney, Agent, or Firm*—Harold A. Williamson

[57] ABSTRACT

The invention is directed to a method and a system that provides for a dual action fluid media circulating and fluid media charge entraining apparatus for use in a chamber having fluid media at a predetermined level into which fluid media a charge to be entrained and mixed is delivered. The apparatus of the system includes a rotary pumping impeller positioned in the chamber near a topmost region of an inlet passage in a wall of the chamber. The fluid media enters the chamber through the inlet passage. The rotary pumping impeller is provided with an inlet opening that draws fluid media vertically upward, to and through the rotary pumping impeller inlet opening to be delivered radially outward as the rotary pumping impeller rotates upon activation.

The dual action apparatus further includes a vortex generating impeller which provided with an inlet opening. The vortex generating impeller is positioned in the fluid media in the chamber between the fluid inlet passage and an outlet passage in the wall. Upon activation of the vortex generating impeller there is generated a vortex in the fluid media. The vortex functions to entrain a charge deposited in the vortex and then to deliver the entrained charge and the fluid media vertically downward into and through the inlet opening of the vortex generating impeller and then radially outward therefrom.

The rotary pumping impeller and the vortex generating impeller cooperate to cause the fluid media and the charge entrained in the fluid media to flow through the chamber from said inlet passage and out the outlet passage for use elsewhere.

17 Claims, 2 Drawing Sheets

FIGURE 3
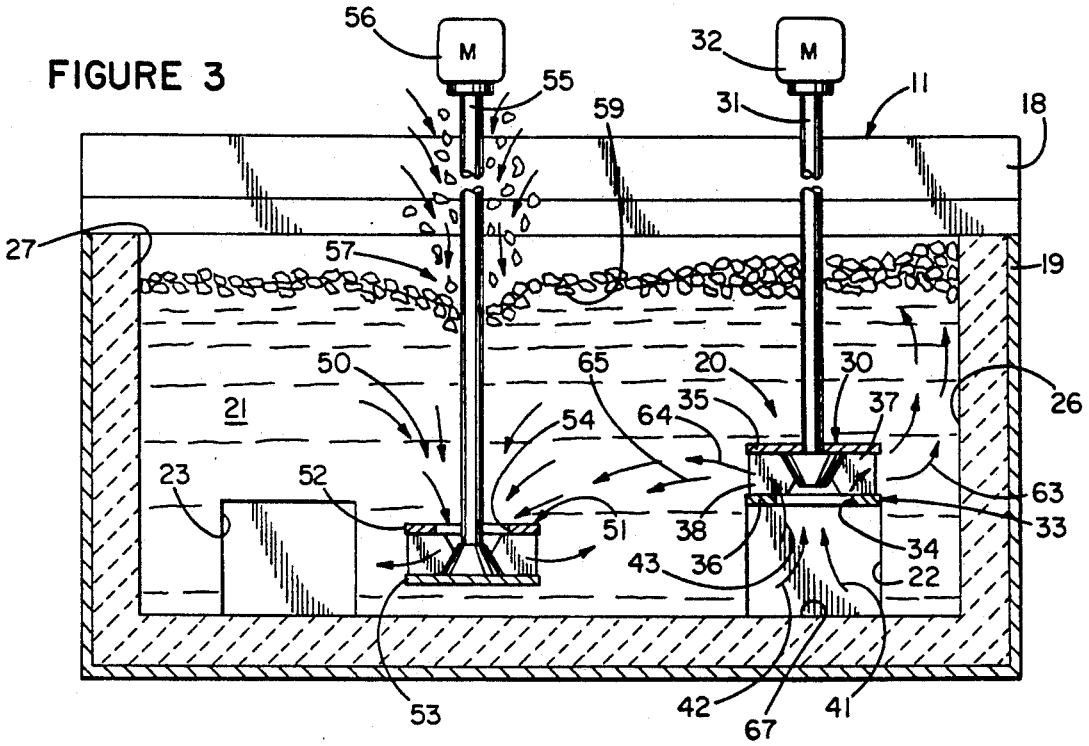
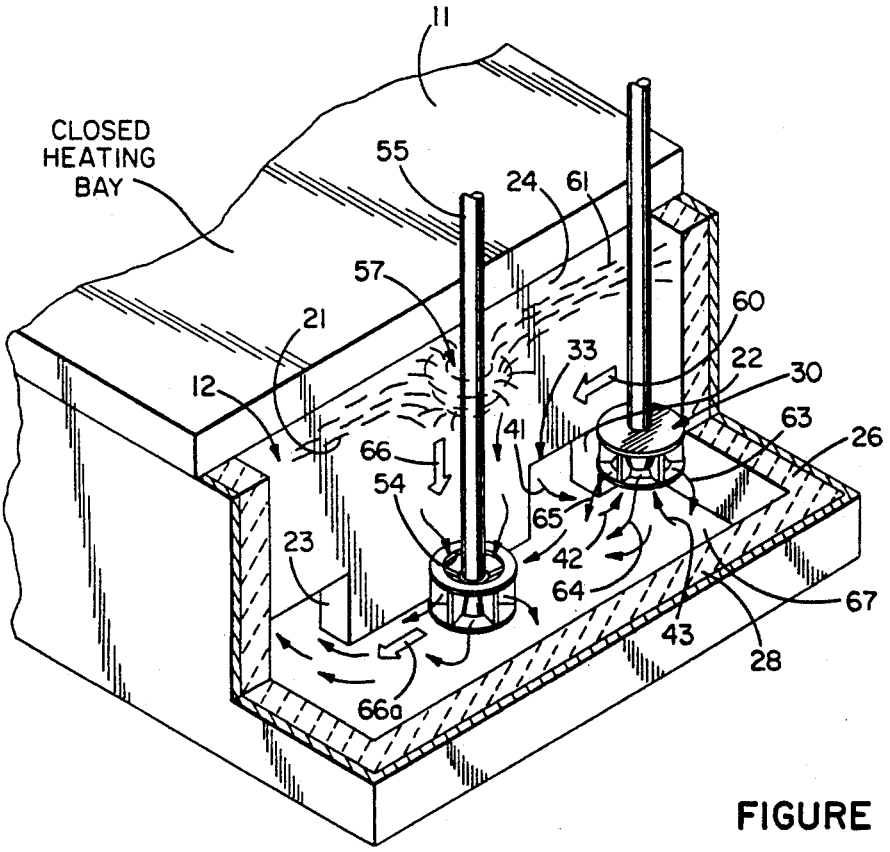
FIGURE 4

DUAL IMPELLER VORTEX SYSTEM AND METHOD

This invention relates to an improved method and apparatus for submerging, entraining and circulating a charge in a fluid media.

BACKGROUND OF THE INVENTION

The need for a method and apparatus for submerging, entraining, melting and circulating a metal charge in a molten media has been vigorously pursued by a number of inventors over the last decade or so. Special attention has been directed to the problems attendant to the recycling of scrap aluminum that has a high surface-to-volume ratio which causes the scrap to float on the surface of the molten aluminum.

The inventor of the subject invention has provided a number of patentable solutions to this problem that have advanced the state of the art, as evidenced by the following patents to Raymodnd J. Claxton: Nos. 4,322,245 ('245('245); 4,386,764 ('764) and 4,592,658 ('658). These patents are variously directed to methods and apparatuses for submerging, entraining, melting and circulating a metal charge in a molten media.

Each of the Claxton Patents, i.e., '245, '764 and '658, describe and claim a novel impeller structure that creates a mild vortex in a molten media. The scrap aluminum charge is delivered into the mild vortex and entrained in the molten media for delivery to and through the novel impeller in such a way that a molten media circulation current is simultaneously developed.

The dual impeller vortex system of the subject invention advantageously allows one of the impellers to be operated continuously to maintain recirculation of molten media even at times when a vortex generating impeller is not being operated. This just described arrangement allows molten metal recirculation during such idle periods when scrap is not being charged. This is beneficial because during such idle periods there is no necessity of introducing agitation associated with vortex in order to maintain circulation.

There have been others that have sought to perfect vortex generation in scrap aluminum reclamation such as J. R. Gillespie in his patient U.S. Pat. No. 4,884,786 of Dec. 5, 1989 titled "Apparatus for Generating a Vortex in a Melt." Gillespie's invention is directed to an aluminum furnace having a charging well in which well an impeller rotates, but the impeller, instead of being supported on a complex framework and massive foundation, is suspended by means of a trolley from an overhead track. The well possesses a somewhat cylindrical configuration and includes both inlet and outlet ports, all arranged to complement a physical configuration of the impeller in establishing and maintaining a suitable vortex. A separate molten media circulation pump is provided in another region of the furnace to provide a circulation current in the molten media to drive molten media through the charging well.

The subject invention does not require a complex charge well wall structure as does Gillespie's but relies upon smooth vertical charge well walls and the cooperation of identical impellers positioned with one impeller inverted and the other impeller adjacent but beneath the one impeller.

Other patents of interest are the Ormesher U.S. Pat. Nos. 4,486,228 and 4,491,474 which, not unlike the Gillespie Patent, require a vortex generating impeller of a novel configuration cooperating with a uniquely configured charging well wall, whereas in the present invention only simple vertical charging well walls are called for.

Yet another patent of interest is the Wayle U.S. Pat. No. 4,893,941 directed to an apparatus for mixing viscous liquid in a container. The Wavle invention utilizes a pair of similar pumping impellers mounted on a single shaft one impeller above the other such that the impellers, when rotated, provide mixing of fluid in a container by positive multidirectionally controlled flow which is enhanced by interaction with walls of the container. Wayle, unlike the subject invention, is inherently incapable of creating a vortex or causing a circulation flow path to be generated independently by one of two impellers.

SUMMARY OF THE INVENTION

The invention is directed to a method and a system that provides for a dual action fluid media circulating and fluid media charge entraining apparatus for use in a chamber having fluid media at a predetermined level into which fluid media a charge to be entrained and mixed is delivered. The "predetermined level" may be referred to hereinafter as a "first level". The apparatus of the system includes a rotary pumping impeller positioned in the chamber between a surface of the fluid media defined by the predetermined fluid media level and a topmost region of an inlet passage in a wall of the chamber. The fluid media enters the chamber through the inlet passage. The rotary pumping impeller is provided with an inlet opening on a bottom side thereof to thereby provide upon activation of the rotary pumping impeller a suction force that draws fluid media vertically upward, to and through the rotary pumping impeller inlet opening to be delivered radially outward as the rotary pumping impeller rotates upon activation. The rotation of the pumping impeller causes the fluid media to move from the fluid inlet passage into the chamber and the inlet opening of the rotary pumping impeller.

The dual action apparatus further includes a vortex generating impeller which is provided with an inlet opening on an upper side thereof. The vortex generating impeller is positioned in the fluid media in the chamber between the fluid inlet passage and an outlet passage in the wall. The inlet and outlet passages are at the same level or as it may be referred to hereinafter as a "Second level" in the wall, such that upon activation of the vortex generating impeller there is generated a vortex in the fluid media. The vortex functions to entrain a charge deposited in the vortex and then to deliver the entrained charge and the fluid media vertically downward into and through the inlet opening of the vortex generating impeller and then radially outward therefrom.

The rotary pumping impeller and the vortex generating impeller cooperate to cause the fluid media and the charge entrained in the fluid media to flow through the chamber from said inlet passage and out the outlet passage for use elsewhere.

The method of the invention entails steps to submerge and entrain a charge in a fluid media where the charge is introduced into a chamber containing the fluid media. The first step calls for generating a fluid media circulation current in the chamber by means of a rotary pumping impeller positioned in the chamber between a surface of the fluid media in the chamber and a topmost region of an inlet passage in a wall of the chamber. The fluid media enters the chamber via the inlet passage. The rotary pumping impeller provides upon activation thereof a suction force that draws fluid media vertically upward, to and through the rotary pumping impeller to be delivered radially outward as the rotary pumping impeller rotates, thereby causing the fluid media to move from the inlet passage into the chamber and through the rotary pumping impeller. The vertically upward movement and the radially outward delivery of the fluid media cooperate to bring about the fluid media circulation current.

A second step of the method entails establishing a vortex in the fluid media to receive the charge which has been introduced into the chamber. The vortex has present there in a charge entraining current in the fluid media which current moves vertically downward and then radially outward. The vortex generating impeller has an inlet on an upper side thereof. The vortex generating impeller is positioned in the fluid media in the chamber between the inlet passage and an outlet in the wall. The inlet and outlet passages in the wall are at the same level so that rotary activation of the vortex generating impeller causes the vortex and the charge entraining current to form in the fluid media.

The fluid media circulation current and the charge entraining current cooperate to cause the fluid media and the charge entrained in the fluid media to flow through the chamber and out the outlet passage for use elsewhere.

It is therefore a primary object of the apparatus of the invention to provide for dual action media molten circulation and molten media charge entraining by means of a pair of relatively large, slowly rotating impellers positioned in a molten media in such a way that one of the impellers is higher than the other and each rotates about separate parallel axes.

Another object of the invention is to generate a molten media circulation current that delivers a molten metal stream directly into a molten media vortex path in which an entrained charge of scrap is to be melted and circulated for further processing.

Yet another object of the invention is to provide scrap entraining and molten media circulation apparatus that can be employed in a conventional furnace having a heating bay that includes a sidewall with two openings that go all the way to a floor of the furnace.

In the attainment of the foregoing objects, the apparatus facet of the invention contemplates a melting system for submerging and entraining a charge in a molten melting media and circulating the entrained charge in the molten melting media from a charging bay through a heating bay and back to the charging bay. The molten melting media fills the bays to a predetermined level. A wall is provided that separates the charging bay and the heating bay. The separating wall has first and second spaced apart openings beneath and equidistant from the predetermined level of the molten melting media.

A molten melting media rotary pumping impeller is positioned between the predetermined level and a topmost region of the first opening. The rotary pumping impeller is provided with a pump inlet opening on a bottom of the rotary pumping impeller to thereby provide upon rotary activation of pumping impeller a suction force that draws molten melting media vertically upward, to and through the rotary pumping impeller inlet to be delivered radially outward as the pumping impeller rotates. The suction force causes molten melting media to move from the heating bay through the first opening into the charging bay and the inlet of the rotary pumping impeller.

A vortex generating impeller is also provided and includes an inlet opening on an upper side thereof. The vortex generating impeller is positioned between the openings and at a level the same as the openings such that activation of the vortex generating impeller causes a vortex to form in the molten melting media. The vortex entrains a charge deposited in the vortex to thereby delivery the charge and the molten melting media vertically downward to and through the inlet opening of the vortex generating impeller and radially outward therefrom.

The rotary pumping impeller and the vortex generating impeller cooperate to cause the molten melting media to flow through the charging bay, the second opening and into the heating bay for recirculation through the first opening into the charging bay.

Other objects and advantages of the present invention will become apparent from the ensuing description and illustrated embodiment thereof, in the course of which, reference is made to the accompanying drawings.

BRIEF DESCRIPTION OF THE DRAWINGS

FIG. 3 is a vertical section taken along line 3—3 of FIG. 1 and shows an open charging bay and illustrates the relative positions of a pumping impeller and a vortex impeller embodying the invention, vis-a-vis openings or passages in a wall separating the charging bay from the heating bay; and FIG. 4 is a three-dimensional illustration of a partially sectioned open charging bay which depicts a pair of impellers embodying the invention and molten melting media charge entrainment and circulation paths present when the apparatus and method of the invention are functioning.

DETAILED DESCRIPTION OF THE PREFERRED EMBODIMENTS

Figure 1:
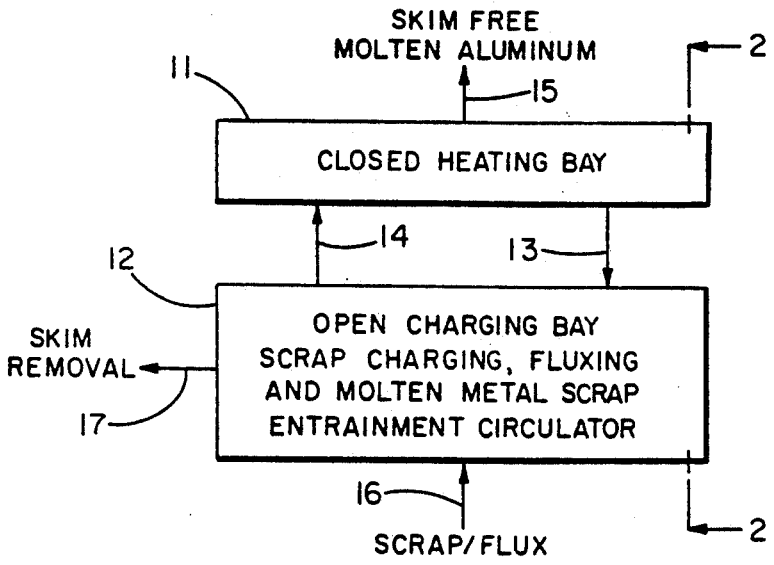
FIG. 1 is a block diagram of a recirculating scrap melting system that embodies the invention.

Reference is now made to FIG. 1 which depicts in block diagram form a recirculating scrap melting system of a type that will embody the invention. The apparatus of the system includes a closed heating bay 11 and open charging bay 12. In the open charging bay 12 scrap and flux are introduced. A dual action molten metal circulating and charge entraining apparatus to be described more fully hereinafter is positioned in the open charging bay 12. The circulating and charge entraining apparatus cause molten metal to circulate from the closed heating bay 11 into the open charging bay 12 as indicated by flow arrow 13. The molten metal is then circulated into the closed heating bay 11 as indicated by flow arrow 14. Scrap and flux are introduced as indicated by flow arrow 16, and skim or dross is removed as indicated by flow arrow 17 from the open charging bay 12. The final product of the system is skim-free molten aluminum delivered from the closed heating bay 11 as indicated by flow arrow 15.

Figure 2:
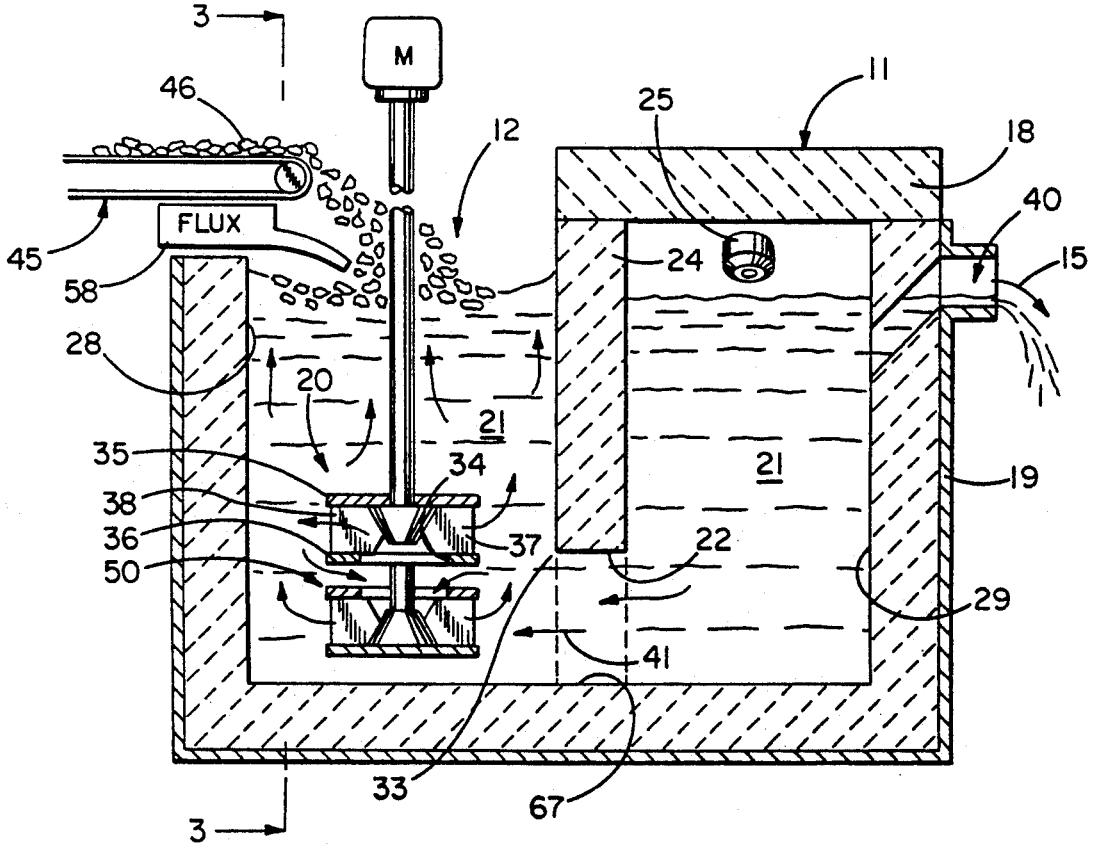
FIG. 2 is a vertical end section taken along line 2—2 of FIG. 1 and shows an open charging bay and a closed heating bay with a rotary pumping impeller and vortex impeller of the invention positioned in a molten media at a level as shown.

Reference is now made to FIG. 2 and FIG. 3. FIG. 2 illustrates a vertical end section of the open charging bay 12 which may be referred to alternatively as simply a chamber and the closed heating bay 11 with a rotary pumping impeller arrangement 20 and vortex generating impeller arrangement 50, embodying the invention, positioned in a molten metal media 21. FIG. 3 illustrates a vertical section of the open charging bay 12 and illustrates the relative positions of the rotary pumping impeller arrangement 20 and the vortex generating impeller arrangement 50, vis-a-vis openings or passage 22, 23. It is to be noted at the outset that the open charging bay 12 may also be referred to from time to time hereafter as an open charging chamber or simply a chamber into which a charge of scrap to be melted is delivered. The views of FIG. 2 and FIG. 3 show the details of a preferred embodiment of the invention.

The description that follows will described the apparatus of both FIG. 2 and FIG. 3 at the same time. In FIG. 2 there is shown, in section, the closed heating bay 11 and the open charging bay 12. The closed heating bay 11 and its details of construction are conventional in the sense that a cover 18 is positioned over the closed heating bay 11. The closed heating bay 11 and open charging bay 12 are constructed of refractory material. In FIG. 2 and FIG. 3 it will be observed that the refractory material is enclosed in a metal shell 19. The metal shell 19 is preferably steel. Gas burners, one of which 25, as seen in FIG. 2, is shown directed downward into the closed heating bay 11. The open and closed bays 11, 12 are shown filled to a predetermined level with a molten metal media 21 in a fluid state which in the preferred embodiment is molten aluminum.

A separating wall 24 has two openings or passages 22 and 23 therethrough. Opening or passage 22 constitutes an inlet passage for molten metal media 21 to enter the open charging bay 12 from the closed heating bay 11. The opening or passage 23 constitutes an outlet passage for the molten metal media that has entrained therein a charge which entrained charge is delivered to the closed heating bay 11 from the open charging bay 12 under the influence of the rotary pumping impeller arrangement 20 and the vortex impeller arrangement 50 to be described more fully hereinafter.

The open charging bay 12 in addition to the separating wall 24 includes end walls 26, 27 and a side wall 28. In viewing FIG. 2 a region near the top of end walls 26, 27, side wall 28 and separating wall 24 may be referred to as an upper most region of a chamber that defines the charging bay. The closed heating bay 11, as seen in FIG. 2, includes a side wall 29 and opening 40 through which skim-free molten aluminum is delivered as indicated by flow arrow 15. The opening 40 in back wall 29 is located at a point beneath the surface of the molten metal media 21 such that any skim that is present in the closed heating bay 11 does not enter the finished molten metal.

Attention is now directed to the rotary pumping impeller arrangement 20 which is composed of an impeller 30 connected by a drive shaft 31 to a motor 32. The motor 32 may be electric or any suitable motor the speed of which can be selected. The impeller 30 is positioned between the surface of the molten metal media 21 which surface is at a predetermined level as shown in the drawing and a topmost region, indicated by an arrow and reference numeral 33, of the inlet opening or passage 22. The impeller 30 of the rotary pumping impeller arrangement 20 has a pump inlet opening 34 on a bottom of the impeller 30 as can be seen in a study of FIG. 2 and FIG. 3. The impeller 30 may have physical configuration similar to the molten metal scrap entrainment circulator of FIG. 5 of my previously issued U.S. Pat. No. 4,322,245 ('245). The impeller 30 of the instant invention differs from the molten metal scrap entrainment circulator of '245 patent in that the impeller 30 of the instant invention is shown inverted with the pump inlet opening 34 opening in a downward direction whereas inlet opening of the molten metal circulator of the '245 opens in a direction towards a surface of a molten metal media.

The impeller 30 of the rotary pumping impeller arrangement 20 is formed of refractory material and constructed by conventional techniques. The impeller has what may be termed a top plate 35 and a bottom plate 36. The inlet opening 34 is located in the bottom plate 36. The top and bottom plates 35, 36 are spaced apart as shown and integrally secured thereto a plurality of radially extending vanes 37, 38 two of which are referenced. The drive shaft 31 is fitted to the top plate in a manner not shown. The radially extending vanes 37, 38 in cooperating with the top and bottom plates act to create a broad region of suction indicated by suction flow arrows 41, 42, 43 (see FIGS. 3 and 4). This suction establishes a force in the molten metal media which is vertically upward towards the impeller pump inlet opening 34. This force causes the molten metal media to flow to and through the pump inlet opening 34 to be delivered radially outward as the motor 32 via drive shaft 31 drives the impeller 30 in a rotary fashion. The molten metal media directly beneath the impeller is drawn upwardly and then heated molten metal from the closed heating bay is drawn through the inlet opening or passage 22 and is delivered to and through the impeller 30 in a radial outward direction where the heated molten metal media cooperates with separating wall 24, end wall 26 and side wall 28 such that molten metal media is forced toward the vortex generating impeller arrangement 50.

A vortex impeller 51 of the vortex generating impeller arrangement 50 has a physical configuration similar to the impeller 30 of the rotary pumping impeller arrangement 20. In fact, the vortex impeller 51 maybe the same as that shown in FIG. 5 of my U.S. Pat. No. 4,322,245 and functions in precisely the same way. The performance of the vortex impeller 51 is significantly enhanced by the presence of the impeller 30 as will be explained hereinafter. As will be observed when FIG. 3 is studied, the vortex impeller 51 includes a top plate 52 and a bottom plate 53. The top and bottom plate are spaced apart and included radially disposed vanes identical in nature to the plate and vane arrangement of the rotary pumping impeller arrangement 20. The top plate 52 is provided with centrally disposed inlet opening 54. The vortex impeller 51 is positioned in the open charging bay 12, as shown in FIG. 3 and FIG. 4 between the inlet and outlet openings or passages 22, 23 in the separating wall 24. The vortex impeller 51 is at the same depth or level in the open charging bay as are the inlet and outlet openings or passages 22 and 23. This just described physical arrangement of the vortex impeller 51 places the vortex impeller 51 with its inlet opening 54 and top plate 52, relatively speaking, below the bottom plate 36 of the pumping impeller 30.

The vortex impeller 51 has integrally secured thereto a drive shaft 55 driving coupled to a motor 56 similar to motor 32 described hereinbefore. When the motor 56 is activated to rotate the drive shaft 55 and the vortex impeller 50, a mild vortex 57 is formed in molten metal media 21. In FIG. 2 there is shown a conveyor 45 that carries thereon scrap 46. The scrap by its nature has a high surface-area-to-volume ratio and therefore tends not to be self-submersible. Shredded aluminum cans or entire cans, as well as small chips collected from manufacturing operations, are typical of non-self-submersible scrap. Also shown adjacent the conveyor 45 is a flux supply 58 shown delivering a fluxing agent into the mild vortex 57 as shown. The mild vortex 57 entrains the scrap and delivers the entrained charge vertically downward to and through the inlet opening 54 and then radially outward therefrom.

Non-self-submersible scrap in order to be drawn into the molten metal media 21 must overcome the surface tension of a layer of skim 59 that forms on molten metal media 21. The non-self-submersible scrap 46 is introduced as shown into the mild vortex 57 created by vortex impeller 51. A severe vortex is to be avoided because the severe vortex while drawing the non-self-submersible scrap into the molten metal also draws the surrounding atmosphere into the vortex thereby greatly enhancing the formation of skim which is a very undesirable by-product.

A highly advantageous outcome arises when the pumping impeller 30 draws heated molten metal from the closed heating bay 11 via inlet opening or passage 22 and forcefully urges the heated molten metal into a downward vortex flow current present beneath the surface of the mild vortex 57. This heated molten metal interacts with scran that has been entrained in molten metal of the mild vortex 57.

This just described forceful urging of the heated molten metal into molten media having scrap entrained therein results in an enhanced melt rate of scrap delivered to the vortex which is an important improvement over the prior art.

In addition to the advantageous outcome just noted, the rotary pumping impeller 30 and the vortex impeller 51 cooperate to cause the molten metal media to flow through the open charging bay 12 and the outlet opening or passage 23 into the closed heating bay 11 for reheating and recirculation through the inlet opening or passage 22 into the open charging bay 12.

Reference is now made to FIG. 4 which presents in three-dimensional form the preferred embodiment of an environment suited to support the inventive method of this specification.

Broadly speaking, the method involves submerging and entraining charge, i.e., scrap 46, in a molten metal media 21 where the charge is introduced into an open charging bay 12 containing the molten metal media 21. The method entails the steps as set forth hereinafter.

First, generating a fluid media circulation current 60 in the open charging bay 12 by means of a rotary pumping impeller 30 positioned in the chamber between a surface 61 of the molten metal media 21 and a topmost region 33 of an inlet opening or passage 22 in a separating wall 24 of the open charging bay 12 through which inlet opening or passage 22 the fluid media enters the open charging bay 12. The rotary pumping impeller 30 provides, upon rotary activation of the pumping impeller 30 a suction force that draws molten metal media 21 to move vertically upward (see flow arrow 42, 43, FIGS. 3 and 4), to and through the pumping impeller 30 to be delivered radially outward, e.g., flow arrows 63, 64, 65 of FIG. 4, as the impeller 30 rotates. This just recited action by the impeller 30 causes the fluid media to move from the inlet opening or passage 22 into the open charging bay 12 and through the pumping impeller 30. The vertically upward movement of the fluid media and the radially outward delivery of the same cooperating in part with the walls 24, 26, 28 to induce or bring about the fluid media circulation current 60.

A second step of the method entails establishing a mild vortex 57 in the fluid media to receive a charge, i.e., scrap 46, which has been introduced, see FIG. 3, into the open charging bay 12. The mild vortex 57 having therein a charge entraining current 66, **66*a* in the fluid media which current moves vertically downward as arrow 66 indicates and then radially outward as arrow 66*a* shows. The vortex generating impeller is positioned in the molten metal media 21 in the open charging bay 12 between the inlet opening or passage 22 and the outlet opening or passage 23 in the separating wall 24. The inlet and outlet openings or passages 22, 23 being at the same level and include a portion of a floor 67 of the open charging bay 12 and closed heating bay 11. The aforementioned positioning of the vortex impeller 51 brings about upon rotary activation of the vortex impeller 51 the formation in the fluid media of the mild vortex 57 and charge entraining current 66, 66*a***.

The fluid media circulation current 60 and the charge entraining current 66, **66*a* cooperate to cause the molten metal media 21 and the charge, i.e., scrap 46, entrained in the fluid media to flow through the open charging bay 12 and out the outlet opening or passage 23** for use elsewhere.

In view of the above description, it should be abundantly clear that the described system and apparatus as well as the method of the systems operation provides a distinct improvement over the prior art, all in a manner that is simple and more efficient than heretofore available.

Although a single embodiment of the present invention has been illustrated and described, it will be apparent to those skilled in the art that various changes and modifications may be made to this embodiment without departing from the spirit and scope of the invention.

What I claim is new:

1. A dual action fluid media circulating and fluid media charge entraining apparatus for use in a chamber having fluid media at a first level into which fluid media a charge to be entrained and mixed is delivered, said apparatus including in combination:

a chamber, a rotary pumping impeller means positioned in said chamber between an upper most region of said chamber and a topmost region of an inlet passage in a wall of said chamber through which inlet passage said fluid media enters said chamber, said rotary pumping impeller means having a pump inlet opening on a bottom of said rotary pumping impeller means to thereby provide upon activation of said rotary pumping impeller means a suction force that draws fluid media vertically upward, to and through said rotary pumping impeller means inlet opening to be delivered radially outward as said rotary pumping impeller means rotates upon said activation, thereby causing said fluid media to move from said fluid inlet passage into said chamber and the inlet opening of said rotary pumping impeller means, a vortex generating impeller means having and inlet opening on an upper side thereof, said vortex generating impeller positioned in said chamber between said inlet passage and an outlet passage in said wall at the same level as said inlet passage such that activation of said vortex generating impeller causes a vortex to form in said fluid media, said vortex entraining said charge to deliver said entrained charge and said fluid media vertically downward to and through said inlet opening of said vortex generating impeller and radially outward therefrom, said rotary pumping impeller means and said vortex generating impeller means cooperating to cause said fluid media and said entrained charge in said fluid media to flow through said chamber form said inlet passage and said outlet passage for use elsewhere.

2. The apparatus of claim 1 wherein said chamber is an open chamber to readily receive said charge into said vortex for entrainment in said fluid media.

3. The apparatus of claim 2 wherein walls of said open chamber define an open chamber rectangular in shape with said inlet passage and said outlet passage positioned proximate to ends of a longer dimension of said rectangular shape.

4. The apparatus of claim 3 wherein said rotary pumping impeller means and said vortex generating impeller means each are characterized by being flat and disk shaped in their overall configuration.

5. The apparatus of claim 4 wherein said flat, disk shaped rotary pumping impeller means rotates about a pump axis perpendicular to a plane defined by said flat disk shaped pumping impeller means and said flat disk shaped vortex generating impeller means rotates about a vortex axis perpendicular to a plane defined by said flat disk shaped vortex generating impeller means.

6. The apparatus of claim 5 wherein said pump axis and said vortex axis are spaced apart and parallel to each other.

7. The apparatus of claim 6 wherein said open chamber walls are vertical and said pump axis and said vortex are parallel to said vertical walls.

8. The apparatus of claim 7 wherein said flat disk shaped pumping impeller means is vertically spaced above said flat disk shaped vortex generating means.

9. The apparatus of claim 8 wherein said inlet passage and said outlet passage are both immediately adjacent a bottom wall of said chamber such that a portion of said inlet passage and said outlet passage includes separate portions of said bottom wall.

10. The apparatus of claim 9 wherein said flat disk shaped vortex generating impeller means is positioned immediately adjacent said bottom wall and at a point between said inlet passage and said outlet passage.

11. The apparatus of claim 10 wherein said flat disk shaped fluid media rotary pumping impeller means and said flat disk shaped vortex generating impeller means when activated rotate in the same direction.

12. The apparatus of claim 11 wherein said radially outwardly delivered fluid media of said flat disk shaped pumping impeller means and the radially outwardly delivered fluid media having an entrained charge from said flat disk shaped vortex generating means cooperate with said vertical walls to thereby provide a motive force to circulate said fluid media and charge entrained fluid media upon activation of one or both of said flat disk shaped pumping impeller means/vortex generating impeller means.

13. The apparatus of claim 12 wherein said flat disk shaped pumping impeller means and said flat disk shaped vortex generating impeller means have the same physical configuration with said inlet of said rotary pumping impeller means inlet opening positioned to receive said fluid media in an upward direction whereas said inlet opening of said flat disk shape vortex generating impeller means is positioned to receive fluid media and entrained charge in a downward direction.

14. A method of submerging and entraining a charge in a fluid media, where said charge is introduced into a chamber containing fluid media, said method comprising:

(a) generating a fluid media circulation current in said chamber by means of a rotary pumping impeller means positioned in said chamber between a surface of said fluid media in said chamber and a topmost region of an inlet passage in a wall of said chamber through which inlet passage said fluid media enters said chamber, said rotary pumping impeller means providing upon activation of said rotary pumping impeller means a suction force that draws fluid media to move vertically upward, to and through said rotary pumping impeller means to be delivered radially outward as said rotary pumping impeller means rotates, thereby causing said fluid media to move from said inlet passage into said chamber and through said rotary pumping impeller means, said vertically upward movement and said radially outward delivery of said fluid media cooperating to bring about said fluid media circulation current, (b) establishing a vortex in said fluid media to receive said charge which has been introduced into said chamber, said vortex having present therein a charge entraining current in said fluid media which current moves vertically downward and then radially outward, said vortex generating impeller positioned in said fluid media in said chamber between said inlet passage and an outlet passage in said wall, said inlet and said outlet passage in said wall being at the same level so that rotary activation of said vortex generating impeller causes said vortex and said charge entraining current to form in said fluid media, said fluid media circulation current and said charge entraining current cooperating to cause said fluid media and said charge entrained in said fluid media to flow through said chamber and out said outlet passage for use elsewhere.

15. The method of claim 14 wherein said fluid media is molten metal.

16. The method of claim 15 wherein said charge is aluminum scrap comprised of aluminum cans, can portions, saw chips or punchings.

17. The method of claim 16 wherein a fluxing agent is simultaneously introduced into said chamber along with said aluminum scrap in close proximity to said vortex.

* * * * *